US005979542A

United States Patent [19]

Inoue et al.

[11] Patent Number: 5,979,542

[45] Date of Patent: Nov. 9, 1999

[54] LAMINATED HEAT EXCHANGER

[75] Inventors: Seiji Inoue; Kunihiko Nishishita, both of Konan; Fumio Ohkubo, Higashimatsuyama, all of Japan

[73] Assignee: Zexel Corportion, Tokyo, Japan

[21] Appl. No.: 09/044,183

[22] Filed: Mar. 19, 1998

[30] Foreign Application Priority Data

Mar. 31, 1997 [JP] Japan ..... 9-098252

[51] Int. Cl.[6] ..... F28F 19/06; F28D 1/03

[52] U.S. Cl. ..... 165/133; 165/134.1; 165/153; 165/176; 165/905

[58] Field of Search ..... 165/133, 153, 165/176, 905, 134.1

[56] References Cited

U.S. PATENT DOCUMENTS

| | | | |
|---|---|---|---|
| 4,209,059 | 6/1980 | Anthony et al. | 165/905 X |
| 4,724,826 | 2/1988 | Muramatsu | 165/133 X |
| 4,901,908 | 2/1990 | Negura et al. | 165/905 X |
| 4,991,647 | 2/1991 | Kawabe et al. | 165/134.1 |
| 5,260,142 | 11/1993 | Kawabe et al. | 165/905 X |
| 5,292,595 | 3/1994 | Yamauchi et al. | 165/905 X |
| 5,351,750 | 10/1994 | Garcia | 165/133 |
| 5,431,217 | 7/1995 | Kadle et al. | 165/153 |
| 5,551,506 | 9/1996 | Nishishita | 165/153 X |
| 5,553,664 | 9/1996 | Nishishita et al. | 165/153 |
| 5,744,255 | 4/1998 | Doko et al. | 165/905 X |

FOREIGN PATENT DOCUMENTS

| | | | |
|---|---|---|---|
| 131698 | 5/1992 | Japan | 165/153 |

*Primary Examiner*—Leonard Leo

*Attorney, Agent, or Firm*—Wenderoth, Lind & Ponack, L.L.P.

[57] ABSTRACT

In order to improve the anticorrosion properties of a flat plate or an intake/outlet passage plate provided at an outermost end in the direction of lamination in a laminated heat exchanger, a sacrificial layer, whose electrical potential is lower than the electrical potential of the core material, is provided at the outer surface of the flat plate or the intake/outlet passage plate located at the outermost end of the laminated heat exchanger in the direction of lamination. The above arrangement prevents corrosion of the core material through sacrificial corrosion of the sacrificial layer.

5 Claims, 8 Drawing Sheets

33
31
32
5
27b
27a
4
25
24
26
16
18
17

LAMINATED HEAT EXCHANGER

BACKGROUND OF THE INVENTION

The present invention relates to a laminated heat exchanger manufactured by alternately laminating tube elements and fins, in which corrosion of the passage plates provided at the two ends in the direction of lamination is prevented.

Laminated heat exchangers in the prior art are manufactured by alternately laminating tube elements each constituted by bonding face-to-face formed plates whose main constituent is aluminum, and fins. For instance, as disclosed in Japanese Unexamined Patent Publication No. H7-294175, tube elements each having a pair of tanks provided at one side and a U-shaped passage communicating between the pair of tanks are laminated alternately with fins over a plurality of levels. The tanks in adjacent tube elements are connected to form two tank groups extending in the direction of lamination. One of the tank groups is partitioned approximately in the middle to be divided into a first communicating area and a second communicating area and the other tank group is in communication throughout with no partitioning. Also intake/outlet passage plate having an intake portion, through which a heat exchanging medium flows in and an outlet portion, through which the heat exchanging medium flows out, is bonded to a flat plate constituting the outermost tube element in the direction of lamination at the end portion of the second communicating area in the direction of lamination.

In addition, the intake portion is made to communicate with the first communicating area via a communicating pipe, whereas the second communicating area is made to communicate with the outlet portion.

A laminated heat exchanger structured as described above is manufactured through brazing in a furnace, with a flat plate employed at an outermost tube element in the direction of lamination, a passage formation plate for changing the positions of the intake portion and the outlet portion bonded on the outside of the flat plate and a jig or the like employed to fix the entire assembly. During this furnace brazing, an aluminum alloy such as #3003, which is not clad with the brazing material emerges in the areas that are in contact with the jig, preventing contact with the jig supporting the laminated heat exchanger.

In a laminated heat exchanger manufactured through furnace brazing, the brazing material is not clad on the outside of the flat plate (also referred to as an end plate) of the outermost tube element with which the jig comes in contact as explained above, thus exposing a core material constituted of, for instance, aluminum alloy #3003. In addition, as in the example of the prior art described above, a core material (such as aluminum alloy #3003) is exposed in a similar manner on the outside of the intake/outlet passage plate.

When the aluminum alloy #3003 constituting the core material is directly exposed in this manner, since the core material does not achieve any sacrificial corrosion, a problem of poor anticorrosion properties arises. The generally practiced solutions to the problem include using a surface clad with a brazing material (aluminum alloy #4004) to come in contact with the jig to prevent the core material from corroding, and increasing the thickness of the plate to improve its anticorrosion properties. However, when the surface, clad with a brazing material, comes in contact with the jig, as in the former case, the process of separating them must be added into the production work, and increasing the plate thickness leads to an increase in the price and an increase in the weight of the laminated heat exchanger.

SUMMARY OF THE INVENTION

Accordingly, an object of the present invention is to provide a laminated heat exchanger that achieves an improvement in its anticorrosion properties by providing a sacrificial layer at the flat plate and the intake/outlet passage plate provided at an outermost end in the direction of lamination.

In order to achieve the object described above, in the laminated heat exchanger according to the present invention, which is constituted by laminating tube elements each having a passage through which heat exchanging medium flows between tanks alternately with fins over a plurality of levels, with at least the tube element at one end in the direction of lamination provided with a flat plate, a sacrificial layer whose potential is lower than that of the core material is provided at the outer surface of the flat plate.

Alternatively, in the laminated heat exchanger according to the present invention, which is constituted by laminating tube elements each having a passage through which heat exchanging medium flows between tanks alternately with fins over a plurality of levels, with at least the tube element at one end in the direction of lamination having a flat plate, and an intake/outlet passage plate for changing the positions of the intake portion and the outlet portion for the heat exchanging medium provided at the flat plate, a sacrificial layer whose potential is lower than that of the core material is provided at the outer surface of the intake/outlet passage plate.

Thus, since a sacrificial layer whose potential is lower than that of the core material is provided at the flat plates at the tube elements at the ends in the direction of lamination or a sacrificial layer whose potential is lower than that of the core material is provided at the intake/outlet passage plate bonded to the flat plate, corrosion of the core material is prevented, thereby improving the anticorrosion properties.

In addition, an aluminum alloy in the 1000 group whose potential is lower than that of the core material or an aluminum alloy in the 7000 group whose potential is, likewise, lower than that of the core material, is employed to constitute the sacrificial layer. Moreover, the aluminum alloy #4004 may be clad as a brazing material at the inner surface of the flat plate or the inner surface of the intake/outlet passage plate.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

The following is an explanation of the preferred embodiments of the present invention in reference to the drawings.

Figure 1:
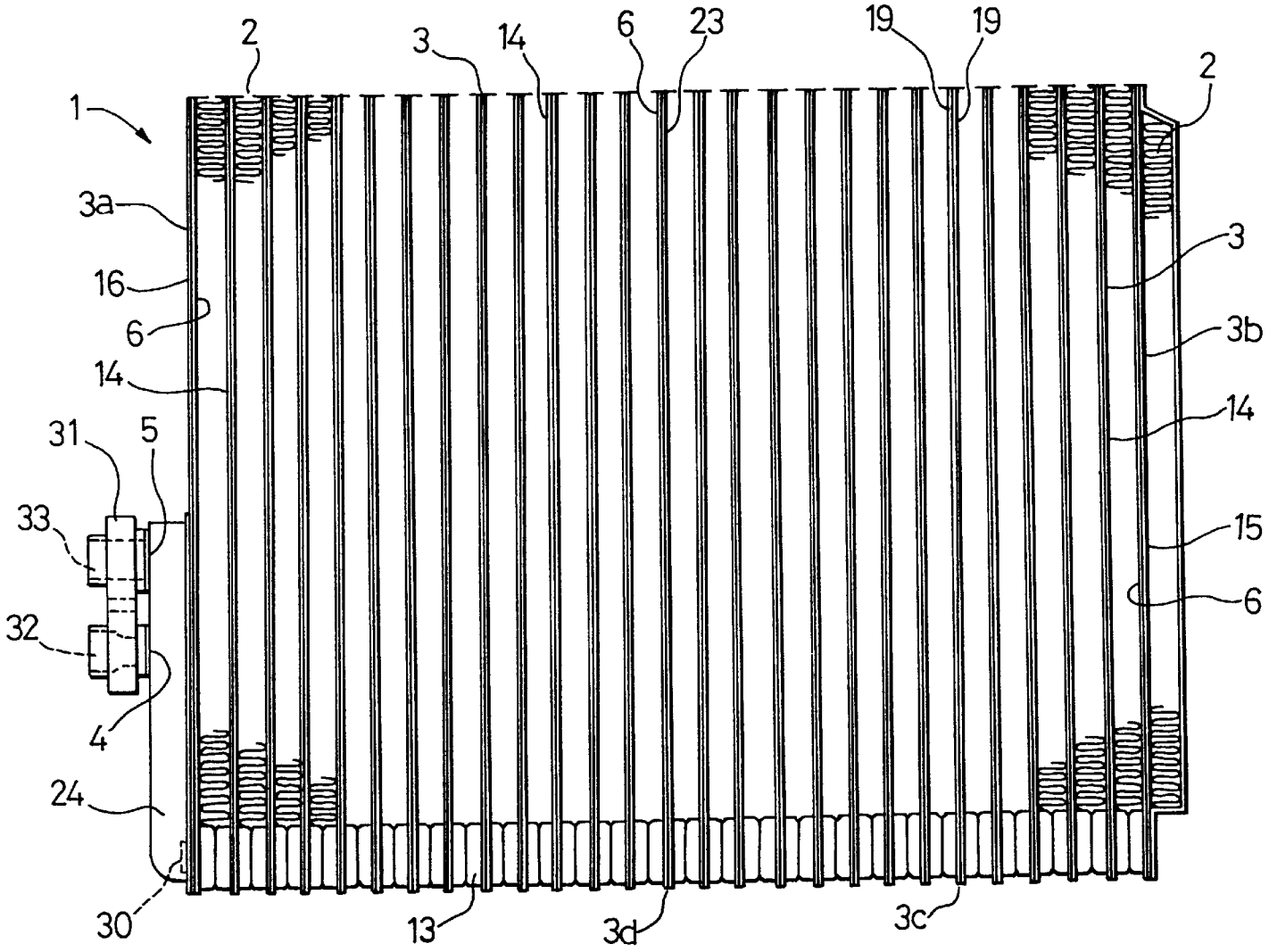
FIG. 1 is a front view illustrating a structural example of the laminated heat exchanger according to the present invention.
Figure 2A:
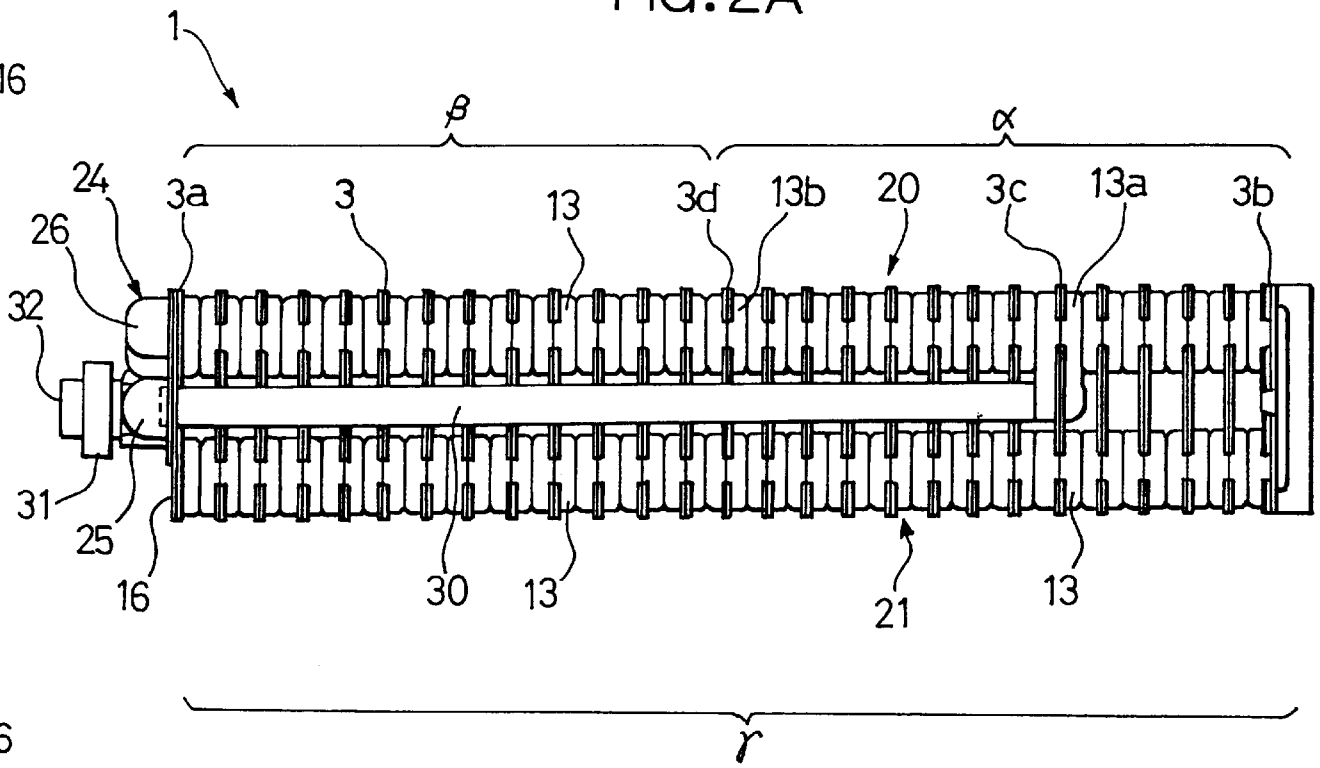
FIG. 2A is a bottom view of the laminated heat exchanger in FIG. 1
Figure 2B:
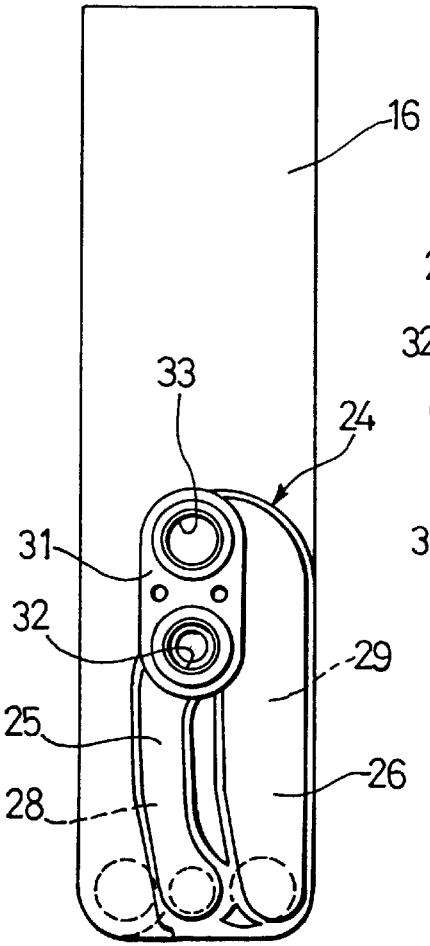
FIG. 2B is a side view of the laminated heat exchanger in FIG. 1.

FIGS. 1, 2A and 2B show an evaporator 1 employed in an air conditioning system for vehicles, for instance, as the laminated heat exchanger according to the present invention, which may adopt a 4-pass system, for instance, with fins 2 and tube elements 3 laminated alternately over a plurality of levels to form a core main body and an inflow port 4 and an outflow port 5 for heat exchanging medium provided at one end in the direction of lamination of the tube elements 3. The tube elements 3 are each constituted by bonding face-to-face two formed plates 6, one of which is shown in FIG. 3, except for tube elements 3*a* and 3*b* at the two end portions of the core main body in the direction of lamination, a tube element 3*c* having an expanded tank which is to be detailed later and a tube element 3*d* located at approximately the middle of the core main body.

The formed plates 6 are each formed by press machining an aluminum alloy whose main constituent is aluminum with both surfaces thereof clad with a brazing material. Each plate 6 has two bowl-like distended portions for tank formation 8 formed at one end, a distended portion for passage formation 9, an indented portion 10 for mounting a communicating pipe 29 which is to be detailed later formed between the distended portions for tank formation 8 and a partitioning wall 11 formed so as to extend from the area between the two distended portions for tank formation 8 to the vicinity of the other end of the formed plate 6. In addition, a plurality of beads 7 are formed in an array with a specific regularity at the distended portion for passage formation 9.

The distended portions for tank formation 8 distend to a larger degree than the distended portion for passage formation 9, and the partitioning wall 11 is formed on the same plane as a bonding margin 12 at the peripheral edges of the formed plate 6. Thus, when two formed plates 6 are bonded to each other at their peripheral edges, their partitioning walls 11 become bonded to each other so that a pair of tanks 13 are formed from the distended portions for tank formation 8 that face opposite each other and a U-shaped heat exchanging medium passage 14 connecting between the tanks 13 is formed from the distended portions for passage formation 8 which face opposite each other.

Figure 3:
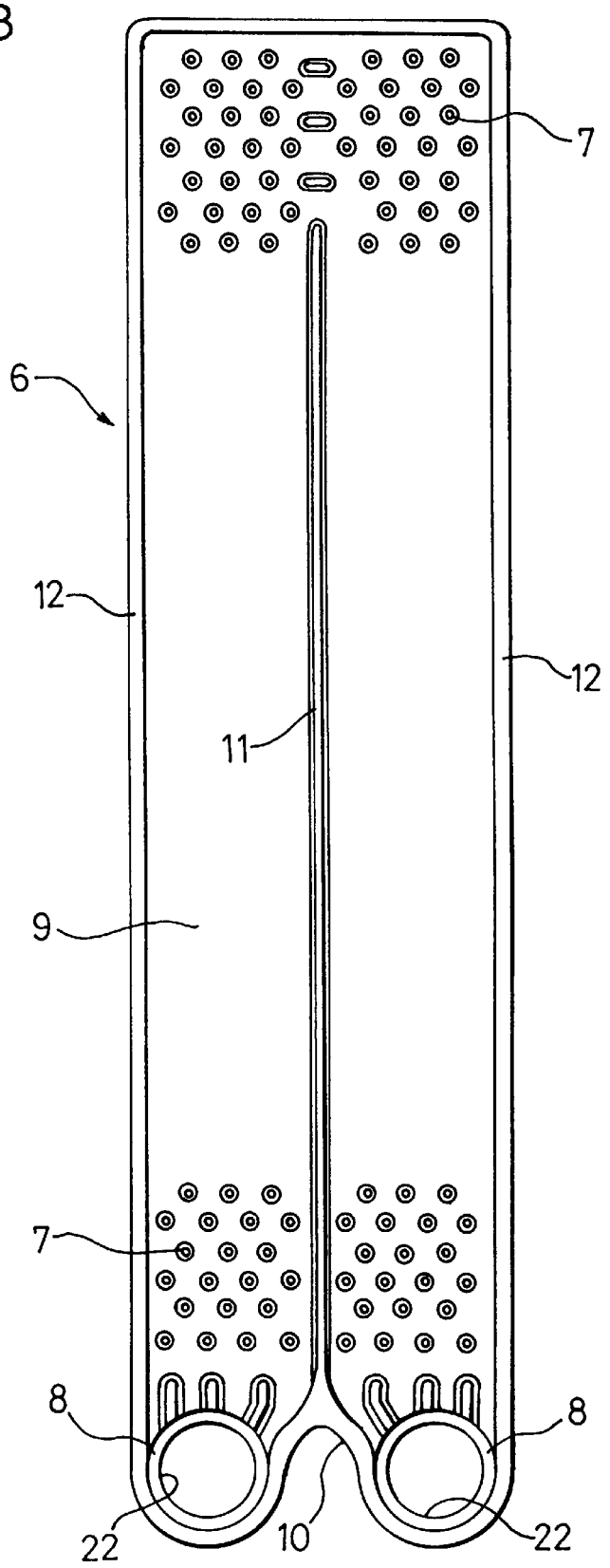
FIG. 3 shows the structure of a formed plate that constitutes a tube element.
Figure 4A:
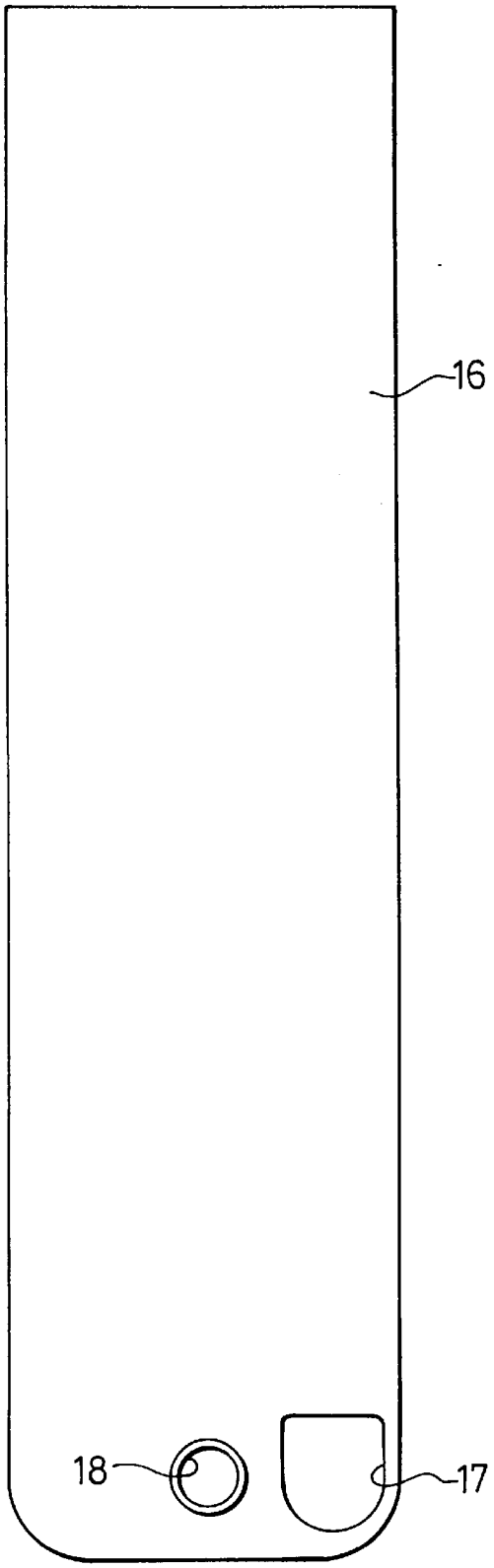
FIGS. 4A and 4B illustrate the structure of the flat plate, with FIG. 4A presenting a front view and FIG. 4B presenting a longitudional cross sectional view.
Figure 4B:
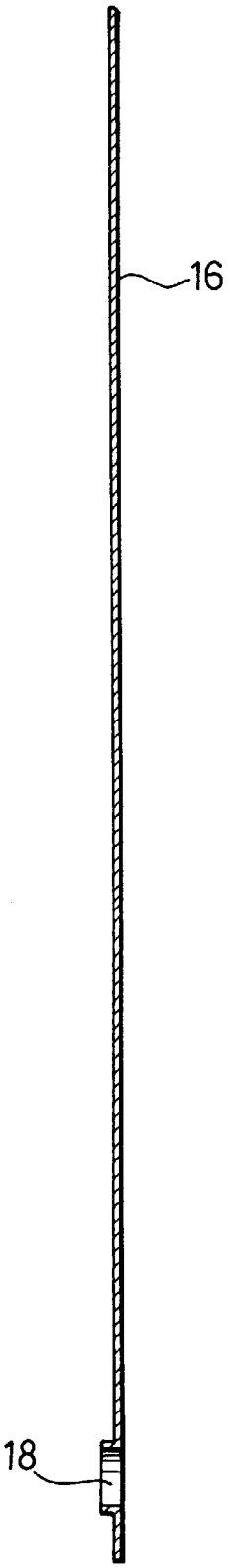

Of the tube elements 3*a* and 3*b* constituting the outer end portions in the direction of lamination, one tube element, i.e., the tube element 3*b* is constituted by bonding a flat plate 15, with no indentations or projections and clad with a brazing material, at both surfaces to the formed plate 6 illustrated in FIG. 3. The other tube element 3*a* is constituted by bonding a flat plate 16, clad with a brazing material, at both surfaces as illustrated in FIGS. 4A and 4B to the formed plate 6 illustrated in FIG. 3. The flat plate 16 shown in FIGS. 4A and 4B is formed in a size that is almost the same as the size of the formed plate 6 to which it is bonded, with a first hole 18 formed at the position facing opposite of the indented portion for pipe mounting 10, and a second hole 17 formed at a position facing opposite of one of the distended portions for tank formation 8 of the formed plate 6.

In addition, the tube element 3*c* is constituted by bonding face-to-face formed plates 19 in which each one of the distended portions for tank formation is expanded so that it approaches the other distended portion for tank formation, and consequently, in the tube element 3*c* a tank 13 whose size is the same as that of the tanks 13 formed in the other tube elements 3 and a tank 13*a* which is expanded to fill the indented portion for pipe mounting 10 are formed.

Furthermore, in the evaporator 1, as illustrated in FIGS. 1, 2A and 2B, adjacent tube elements are abutted at their tanks 13 and 13*a*, with two tank groups, i.e., a first tank group 20 and a second tank group 21 extending in the direction of lamination (the direction perpendicular to the direction of the airflow) constituted by a series of abutted tanks 13 and 13*a*. In the first tank group 20, which includes the expanded tank 13*a*, the individual tanks 13 are in communication with each other through communicating holes 22 (shown in FIG. 3) formed at the distended portions for tank formation 8 except at the tube element 3*d*, which is located at approximately the center in the direction of lamination.

More specifically, the tube element 3*d* is constituted by bonding face-to-face the formed plate 6 shown in FIGS. 2A and 2B and a formed plate 23 which is formed similar to the formed plate 6 but without a communicating hole formed at one of its distended portions for tank formation 8 to form a blind tank 13*a*. This tube element 3*d* divides the first tank group 20 into a first tank block a that includes the expanded tank 13*a* and a second tank block β that communicates with the outflow port 5. In addition, in the second tank group 21, all the tanks are in communication with each other through communicating holes 22 without partitioning to constitute a third tank block γ.

Figure 5:
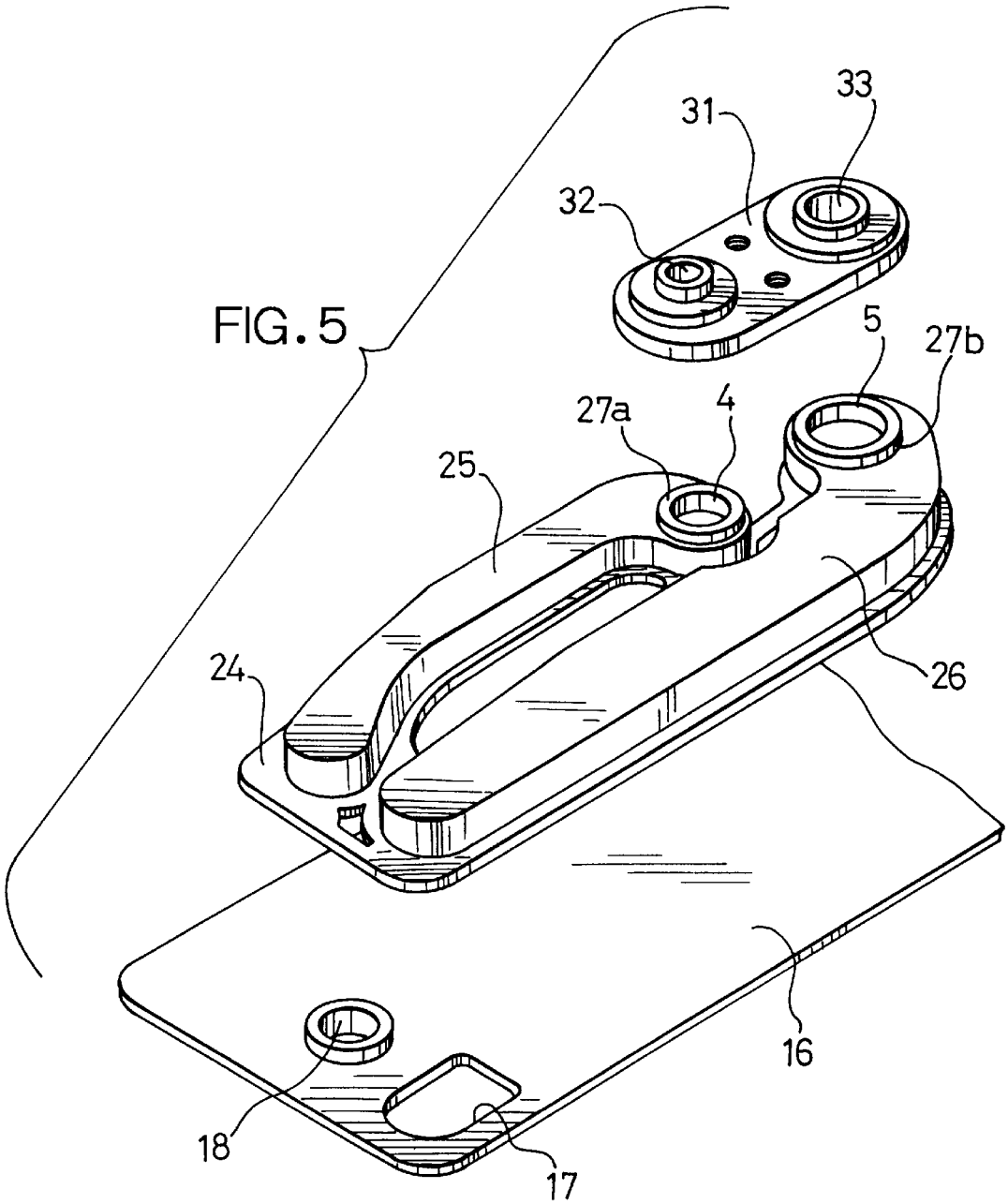
FIG. 5 is an exploded view of the structure of the intake/outlet.

At one end in the direction of lamination, an intake/outlet passage plate 24 is bonded since it is necessary to provide the inflow port and the outflow port through a piping connection at approximately the middle of the side surface of the flat plate 16, as illustrated in FIG. 5. In this intake/outlet passage plate 24, two bulging portions, i.e., a first bulging portion 25 and a second bulging portion 26, are formed distending side-by-side through press machining, with the inflow port 4 having a circular projection 27*a*, formed through burring at one end of the first bulging portion 25, and the outflow port 5 having a circular projection 27*b*, formed through burring at the end of the second bulging portion 26, at the same side. By bonding the intake/outlet passage plate 24 to the flat plate 16, an inflow passage 28 communicating with the inflow port 4 and an outflow passage 29 communicating with the outflow port 5 are formed between the intake/outlet passage plate 24 and the flat plate 16, and the inflow passage 28 communicates with the first tank block α with the other end of the communicating pipe 30 whose one end is connected to the expanded tank 13*a* connected to the first hole 18 of the flat plate 16. The outflow passage 29 communicates with the second tank block β via the second hole 17 at the flat plate 16. In addition, a coupling 31 for securing an expansion valve which is to be detailed later is bonded to the inflow port 4 and the outflow port 5. Also, through holes 32 and 33 are formed at the coupling 31.

The heat exchanging medium that has flowed in through the inflow port 4 enters the expanded tank 13*a* through the inflow passage 28 and the communicating pipe 30 to become dispersed over the entire first tank block α, and then flows via the heat exchanging medium passages of the tube elements corresponding to the first tank block α along the partitioning walls 11 (first pass). Then, it travels downward after making a U-turn above the partitioning walls 11 (second pass) and reaches the tank group at the opposite side (the third tank block γ). After this, it moves horizontally to the remaining tube elements constituting the third tank block γ to flow through the heat exchanging medium passages 14 of the remaining tube elements along their partitioning walls 11 (the third pass). Next, it makes a U-turn above the partitioning walls 11 before traveling downward (the fourth pass) to the tanks 13 constituting the second tank block β, and then it travels through the outflow passage 29 to flow out through the outflow port 5. Thus, the heat of the heat exchanging medium is conducted to the fins 2 during the process in which it flows through the heat exchanging medium passages 14 corresponding to the first through fourth passes so that heat exchange is performed with the air passing between the fins 2.

Figure 6:
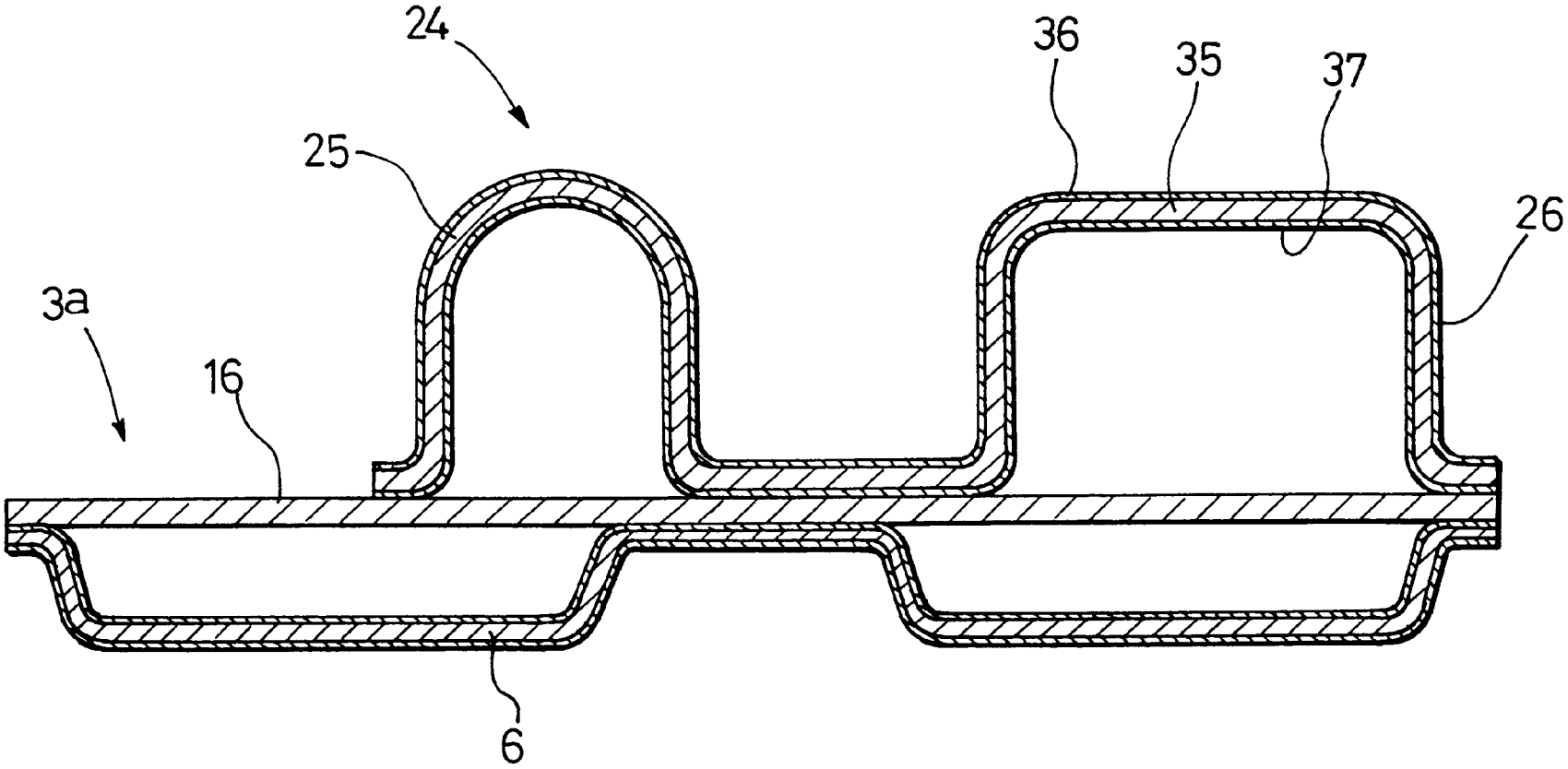
FIG. 6 is a cross sectional view illustrating the intake/outlet passage plate connected to the tube element 3*a;*

Now, while the first bulging portion 25 and the second bulging portion 26 are formed through press machining so as to distend at the intake/outlet passage plate 24, as explained earlier, the intake/outlet passage plate 24 is constituted of aluminum alloy #3003 as a core material 35, and is clad with an aluminum alloy #1050 whose potential is lower than that of the core material at its outer surface and with an aluminum alloy #4004 (brazing material) at its inner surface, as illustrated in FIG. 6. In other words, a sacrificial layer 36 whose potential is lower than that of the core material is provided at the outer surface of the intake/outlet passage plate 24 and a brazing material 37 is provided at its inner surface.

Consequently, since the sacrificial layer 36 is provided at the outer surface of the intake/outlet passage plate 24, the sacrificial layer 36 becomes corroded and prevents the core material 35 from becoming corroded. It is to be noted that the sacrificial layer 36 may be constituted of an aluminum alloy in the #1000 group or an aluminum alloy in the #7000 group such as the aluminum alloy #7072 that has a high Zn content, as long as its potential is lower than that of the core material. In addition, in FIG. 6, the formed plate 6 that is bonded face-to-face with the flat plate 16 is clad with the brazing material (aluminum alloy #4004) at both side surfaces.

Figure 7:
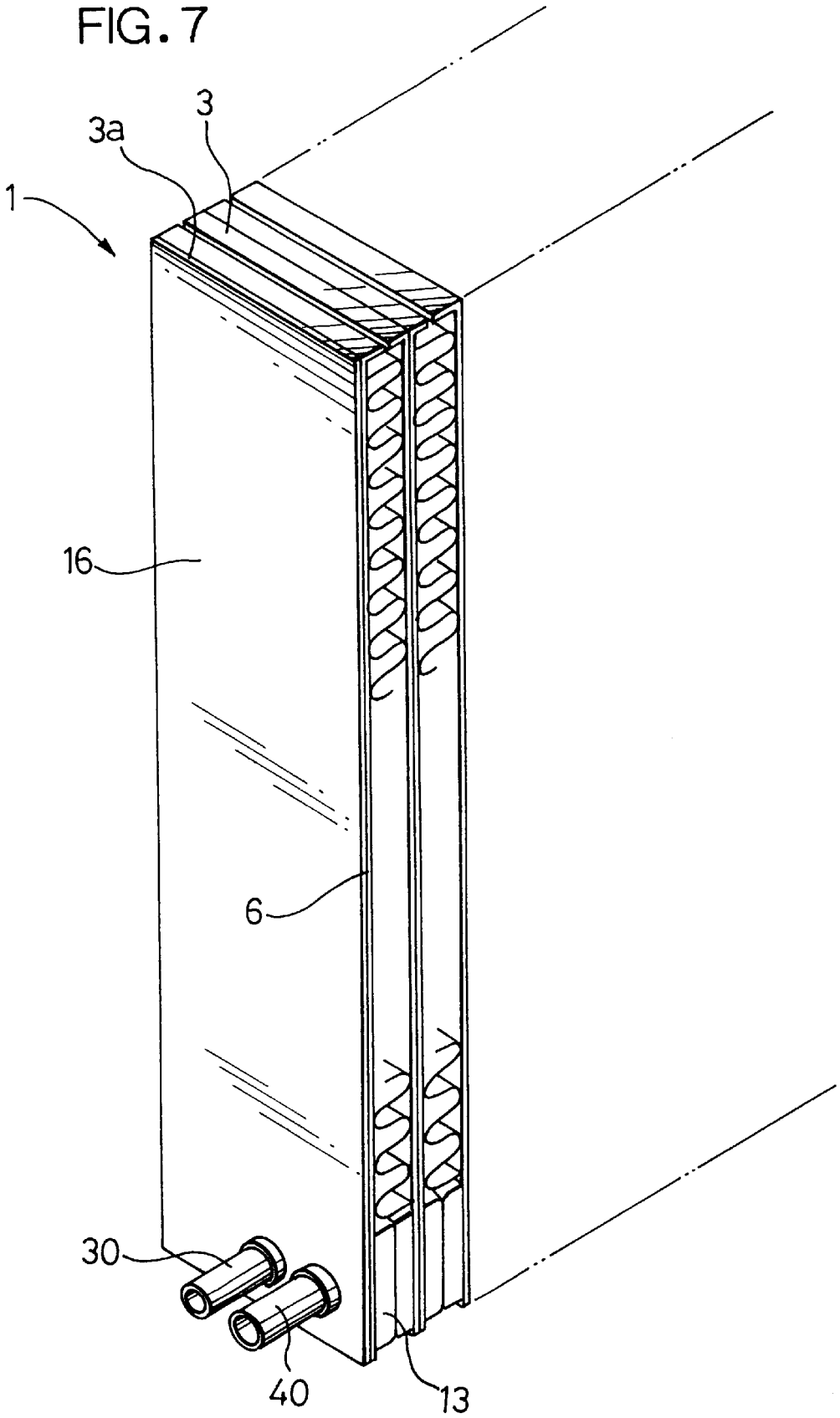
FIG. 7 is a perspective of another embodiment of the present invention illustrating an essential portion of a laminated heat exchanger which does not require an intake/outlet passage plate.
Figure 8:
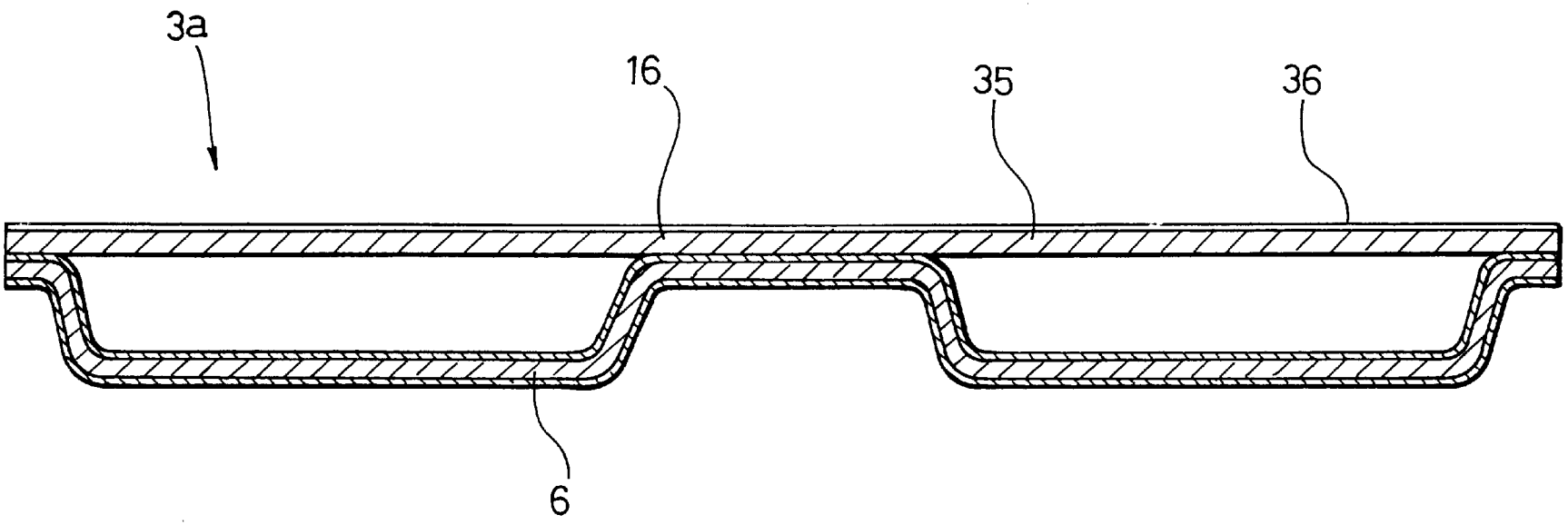
FIG. 8 is a cross sectional view of an essential portion of the tube element 3*a* in the laminated heat exchanger.

In another embodiment of the present invention illustrated in FIGS. 7 and 8, unlike in the previous embodiment, the intake/outlet passage plate 24 is not provided since it is not necessary to provide an inflow port and outflow port in the middle of the side surface to accommodate the piping connection. In this case, as illustrated in the figures, the tube element 3*h* at an outer end of the laminated heat exchanger 1 is constituted of the flat plate 16 and the formed plate 6, with an outlet pipe 40 communicating with the second tank block β provided at the lower end of the flat plate 16 where the communicating pipe 30 that communicates with the first tank block α is also inserted and projected out.

In the flat plate 16 in this embodiment, as shown in FIG. 8, an aluminum alloy #3003 is employed to constitute its core material 35 and an aluminum alloy in the 1000 group such as the aluminum alloy #1050 or in the 7000 group such as aluminum alloy #7072 whose potential is lower than that of the core material 35, is clad on the outside. As a result, since a sacrificial layer 36 is formed at the outer surface of the flat plate 16, the sacrificial layer 36 becomes corroded to prevent the core material 35 from becoming corroded. It is to be noted that in FIG. 8, the formed plate 6 which is bonded face-to-face with the flat plate 16 is clad with a brazing material (aluminum alloy #4004) at both side surfaces.

As has been explained, according to the present invention, in a laminated heat exchanger having an intake/outlet passage plate provided at an outermost end in the direction of lamination or having a flat plate at an outermost end in the direction of lamination without an intake/outlet passage plate provided, since a sacrificial layer, whose electrical potential is lower than that of the core material of the intake/outlet passage plate or the flat plate, is provided at the outer surface of the intake/outlet passage plate or the flat plate, the core material is prevented from becoming corroded to achieve an improvement in durability. Thus, an advantage is achieved in that a high degree of corrosion resistance is realized without having to take measures such as increasing the plate thickness.

What is claimed is:

1. A laminated heat exchanger comprising:

a core main body including a plurality of tube elements laminated alternately with a plurality of fins;

a pair of flat plates disposed at opposite ends of said core main body, respectively;

wherein said plurality of tube elements define a plurality of intermediate tube elements and a pair of side tube elements at opposite ends of said laminated heat exchanger in a lamination direction, each of said intermediate tube elements comprising a pair of formed plates which each include a pair of indented portions for tank formation and an indented portion for heat exchanging medium passage formation, said formed plates being abutted with each other so as to define a pair of tanks and a heat exchanging medium passage communicating between said pair of tanks, each of said side tube elements being formed by abutting one of said flat plates with one of said formed plates;

an intake/outlet passage plate secured on one of said flat plates so as to form an inflow passage and an outflow passage extending along said one flat plate;

wherein said tanks of said tube elements are fluidly connected so as to define a pair of tank groups;

wherein one of said tank groups defines a first tank block and a second tank block separated from each other at approximately a center of said one tank group;

wherein the other of said tank groups defines a third tank block;

wherein said first tank block is located remotely from said intake/outlet passage plate and includes an expanded tank portion;

wherein one of said flat plates includes a first hole formed adjacent an end of said one flat plate with respect to a longitudinal direction thereof, said first hole being centrally disposed between opposite sides of said flat plate with respect to a widthwise direction thereof, and a second hole providing fluid communication between said outflow passage and said second tank block;

wherein a communicating pipe extends between said expanded tank portion and said one flat plate, an end of said communicating pipe being inserted into said first hole so as to communicate between said inflow passage and said expanded tank portion;

a first sacrificial layer provided on outer surfaces of said flat plates in the lamination direction at a location contacting jigs, said first sacrificial layer being formed of a material having an electric potential which is inferior to an electric potential of a core material forming said flat plates;

a second sacrificial layer formed on an outer surface of said intake/outlet passage plate in the lamination direction at a location contacting the jigs, said second sacrificial layer being formed of a material having an electric potential which is inferior to an electric potential of a core material forming said intake/outlet passage plate; and wherein said laminated heat exchanger is formed by clamping and securing together said core main body, said flat plates and said intake/outlet passage plate with the jigs which contact said first and second sacrificial layers, and then brazing said core main body, said flat plates, and said intake/outlet passage plate in a furnace.

2. A laminated heat exchanger as claimed in claim 1, wherein said material forming said first and second sacrificial layers is an aluminum alloy in the 1000 group.

3. A laminated heat exchanger as claimed in claim 1, wherein said material forming said first and second sacrificial layers is an aluminum alloy in the 7000 group.

4. A laminated heat exchanger as claimed in claim 1, wherein the other flat plate is provided with a brazing material on an inner surface thereof so as to form a trilaminar structure including said first sacrificial layer, said core material and said brazing material.

5. A laminated heat exchanger as claimed in claim 4, wherein said brazing materials are comprised of an aluminum alloy #4004.

* * * * *